US005460380A

United States Patent [19]

Ober

[11] Patent Number: 5,460,380

[45] Date of Patent: Oct. 24, 1995

[54] TETHERED BALL GOLF SWING PRACTICE MAT

[76] Inventor: Audrey C. Ober, 4138 Timbervale, Evergreen, Colo. 80439

[21] Appl. No.: 213,915

[22] Filed: Mar. 15, 1994

Related U.S. Application Data

[63] Continuation-in-part of Ser. No. 98,115, Jul. 27, 1993.

[51] Int. Cl.[6] ..... A63B 69/36

[52] U.S. Cl. ..... 273/196; 273/200 R; 273/208; 273/58 C; 273/185 C

[58] Field of Search ..... 273/26 E, 26 EA, 273/58 C, 185 C, 185 D, 184 B, 196, 198, 200 R, 200 B, 208, 209, 319, 331, 335, 413

[56] References Cited

U.S. PATENT DOCUMENTS

| | | | |
|---|---|---|---|
| D. 319,092 | 8/1991 | Dennesen . | |
| 466,691 | 7/1936 | Anderson . | |
| 1,527,716 | 5/1923 | Tippen eet al. . | |
| 1,555,124 | 3/1923 | Lambert . | |
| 2,656,720 | 1/1951 | Sonnett . | |
| 3,521,887 | 7/1967 | Butkus | 273/200 R |
| 3,767,198 | 10/1973 | Boyer | 273/26 E |
| 4,092,027 | 5/1978 | Carter . | |
| 4,095,798 | 6/1978 | Marple . | |
| 5,072,937 | 12/1991 | Zarate | 273/26 E |
| 5,135,219 | 8/1992 | Mckeon et al. | 273/26 E |

FOREIGN PATENT DOCUMENTS

| | | | |
|---|---|---|---|
| 275272 | 1/1928 | United Kingdom | 273/208 |

OTHER PUBLICATIONS

"The Swing Groover", by Dennco, Inc.
"Electronic Swing Groover", by Dennco, Inc.

*Primary Examiner*—V. Millin
*Assistant Examiner*—William M. Pierce
*Attorney, Agent, or Firm*—Timothy J. Martin

[57] ABSTRACT

A golf training device having a base and a golf ball tethered to it by way of a cord. The base has a protective structure in the form of an upwardly extending resilient member or transverse rod to protect the cord from abrasion when the ball is hit.

32 Claims, 7 Drawing Sheets

TETHERED BALL GOLF SWING PRACTICE MAT

RELATED APPLICATION

The present invention is a continuation-in-part of U.S. patent application Ser. No. 08/098,115 filed Jul. 27, 1993.

FIELD OF THE INVENTION

The present invention broadly relates to golf training devices and, more specifically, the present invention relates to apparatus for use by a golfer in practicing his/her golf swing. The present invention particularly concerns golf practice devices that provide a tethered golf ball so that the practice device may be used in confined areas as well as outdoors.

BACKGROUND OF THE INVENTION

The game of golf has historically been a favored pastime for a large segment of population, and the game of golf currently enjoys vast popularity by people of both sexes and of all ages. One reason that golf enjoys such popularity is that it may be played as a social activity by persons having various skill levels without diminishing the enjoyment for each individual participant. Also, while golf can be a competitive sport, a player primarily plays the course to get his/her best score regardless of other player's scores.

As is well-known, the game of golf is played on a golf course which usually has eighteen holes, although courses with fewer holes exist. Each hole is a selected distance from a tee-box wherein a golfer initially strikes the ball to launch it toward a green that provides a hole or cup into which the ball is to be ultimately directed. Holes may range on the order of one hundred yards (ninety meters) to six hundred yards (five hundred forty meters) although these distances may certainly be both shorter and longer than this range. In order to reach the green, the golfer employs clubs, either woods or irons, which have different lifts and weight so that the ball flies a calculated distance. Once on the green, the golfer uses a putter to roll the ball until it is ultimately hit into the hole or cup.

As with most sports, the best way to improve one's performance is to practice. Golf is no exception, and it is known that a golfer's game (as evidenced by lower score) can be improved by practicing hitting the golf ball. While it is relatively easy to practice putting, it is more difficult hitting longer golf shots such as would occur from the tee-box or fairway to the green. This practice hitting or driving is most frequently done at driving ranges. Here, a large target area is provided into which a golfer hits a golf ball, and the golfer normally receives a large number of balls with which to practice from a designated tee-box area. The target area of a driving range is calibrated in distance so the golfer can determine the distance of a hit and the accuracy of the aim. This is important since golfers may hook, slice or otherwise errantly hit a golf ball so that the success of the shot depends both on distance and accuracy. Going to a driving range can be time-consuming, expensive and inconvenient. Therefore, it is desirable to provide golf practice devices which may be utilized in a confined area or which otherwise do not require retrieval of the practice ball. While it is known to employ a retaining net into which a golfer may hit his/her ball for practice, these nets are large and unwieldy. The present invention is instead directed to devices which provide tethered golf balls as part of a golf swing practice device.

One example of a personal use golf practice device is shown in U.S. Pat. No. 4,095,798 issued Jun. 20, 1978 to Marpel. In this practice device, a golf ball is mounted to the proximal end of a cord which has the distal end connected to a rubber strap that, in turn, is tethered to a cork-screw stake which is screwed into the ground. U.S. Pat. No. 4,092,027 issued May 30, 1978 to Carter likewise shows a tethered golf ball which is connected to a cord that is approximately ten feet (three meters) to fifty feet (fifteen meters) that is then connected to an anchoring spike driven into the ground. A drive mat in the form of a section of artificial turf is provided as a tee-box located remotely from the stake. In U.S. Pat. No. Des. 319,092 issued Aug. 13, 1991 to Dennesen shows a golf ball attached to a swing; when hit, the golf ball swings around a stake.

Another example of a tethered golf ball practice device is shown in U.S. Pat. No. 1,555,124 issued Sep. 29, 1925 to Lambert. Here, a practice mat is provided, and a golf ball is tethered to a cord by means of a yoke-assembly, and the other end of the cord is connected to a spring array located underneath the mat. U.S. Pat. No. 2,656,720 issued Oct. 27, 1953 to Sonnett employs a box-like structure that has an upright tee to support a golf ball. The golf ball is tethered to a cord which extends downwardly through the tee and is connected to a resistance mechanism. An indicator is provided to estimate the distance that the ball would have traveled in the '720 Patent. British Patent 466,691 issued Jun. 2, 1937 to Anderson shows a specially fabricated ball, made out of sponge rubber, which is molded to simulate the appearance and size of a golf ball and includes a tee structure integrally molded therewith. The tee structure is connected to a length of elastic, and this elastic extends through a hole in a mat and is anchored underneath the mat. The method of anchoring includes the use of two additional elastic strips arranged in a V-fashion beneath the mat. U.S. Pat. No. 1,527,716 issued Feb. 24, 1925 to Tippen et al shows a tee and stake structure formed as a common unit. The stake is driven into the ground, and a golf ball is tethered to a pulley assembly internally of the stake.

While each of these inventions have some advantages, such as home use and convenience, there is still some limitations and disadvantages of each. The commercially available net can be dangerous because a poorly hit golf ball may entirely miss the net. Those devices requiring stakes are inconvenient to transport and are potentially dangerous, and can not be readily used indoors. Moreover, those devices which have long cords or which are secured by elastic elements may rebound upon reaching the end of the cord or rope and strike the golfer or other persons upon the rebound. Moreover, should the cord break, due to abrasion or other defects, the ball can cause damage to persons and property. Where plastic or foam golf balls are used to avoid injury, these balls do not give the golfer a true feel in driving the ball. Additionally, where standard golf balls are tethered, they tend to deteriorate quickly and may break so that pieces fly off of the cord.

Accordingly, there is a need for an improved indoor/outdoor golf practice device that remains substantially where it is placed without having to drive it or stake it into the ground. There remains a need for a golf practice device which a golfer may use without being unduly concerned about being struck by the golf ball or by striking other persons or objects with the golf ball if either the cord breaks or the golf ball itself breaks or rebounds. The present invention, therefore, is directed to meet these needs.

SUMMARY OF THE INVENTION

An object of the present invention is to provide a new and useful golf swing practice device which may readily be employed indoors or outdoors.

Still another object of the present invention is to provide a portable, light-weight, one-piece device for practicing a golf swing.

A further object of the present invention is to provide a golf swing practice device which can be used without stakes.

Another object of the present invention is to provide a golf swing practice device which has a tethered golf ball capable of withstanding multiple hits without ball deterioration.

Yet another object of the present invention is to provide a golf practice device which utilizes a real golf ball to give a golfer the true feel of driving the golf ball.

A further object of the present invention is to provide a golf practice device which allows the golfer to determine if his/her drive was a hook, slice or a straight hit, or otherwise to help determine if the golf ball has been properly struck.

A further object of the present invention is to provide a golf swing practice device employing a real golf ball which is tethered by a relatively short cord and which is safe to use because of both the thickness of the cord and its construction.

According to the present invention, then, a golf swing practice device is adapted to be positioned on a support surface in order to allow a golfer to practice striking a golf ball with a golf club. Broadly, the golf swing practice device includes a base that has a lower surface that is positioned on the support surface and an upper surface located oppositely the lower surface. The base has a drive area on the upper surface wherein a golf ball may be placed for a practice hit. Here, the golf ball is secured to the distal end of a cord, a proximal end of the cord is tethered to the base. The cord is secured relative to a first location spaced from the drive area so that the cord can extend across the upper surface of the base to terminate at the distal end and the golf ball. The golf swing practice device also includes a protective structure associated with and located proximately to the first location, and this protective structure is operative to support the cord against abrasion caused by repeated striking of the golf ball.

The protective structure may be a resilient member that extends upwardly from the base at the first location to terminate in a top portion. This resilient member has a hollow shaft that provides an upright axial passageway extending therethrough from the lower surface of the base to the top portion of the resilient member. The cord may then extend the distal end, through the axial passageway and across at least a portion of the lower surface after which it is secured remotely from the axial passageway. Thus, the resilient member is operative to flex under a force applied by the cord as the golf ball is struck, and the cord is accordingly protected against abrasion. Whereas the resilient member may be formed integrally with the base, it is preferably formed independent of the base, and an opening is provided at the first location so that the resilient member may be inserted through the opening. Here, the resilient member includes a radial flange at a bottom portion so that the flange can abut the lower surface when the resilient member is mounted to the base.

Alternatively, the protective structure may be in the form of a transversely oriented rod mounted to the lower surface of the base adjacent to an opening through which the cord may extend. Here, the opening defines the first location to which the cord is relatively secured. To accomplish this, the cord is trained around the rod and through the opening so that the arcuate surface of the rod, along with the arcuate edge of the opening, protects the cord from abrasion.

In any event, it is preferred that the golf ball be an approved golf ball of standard size and weight through which a diametric bore is formed. Preferably, the distal end of the cord is formed as a loop which extends through the bore so that this looped portion defines a york connected to the golf ball. A slidable clip may be disposed on the cord to adjust the effective size of the loop or york and, in the preferred embodiment, an elongated cord is doubled on itself to define the distal cord loop with first and second cord sections extending therefrom to terminate in first and second proximal end portions that are attached relative to the base. Moreover, it is preferred that the diametric bore formed in the golf ball be fitted with a sleeve formed of a material having a durometer that is greater than the durometer of the golf ball, and the loop then extends through this sleeve. Here, the sleeve may be a separate element or may be molded integrally with the golf ball.

It is preferred that the cord be formed out of a single elongated piece of cord material that is folded upon itself and secured by the clip to form the distal loop with two elongated cord sections extending therefrom. Where a resilient member is used as the protective structure, these cord sections may be secured directly to the resilient posts. However, where the resilient member having a hollow shaft is employed, it is preferred that the cord sections be threaded through the shaft at the forward portion of the base and then rearwardly to attach at spaced apart locations at a rearward portion of the base. Here, at least a portion of the cord sections extend underneath the base along the lower surface thereof. Where the protective structure is the transverse rod, medial portions of the cord sections extend forwardly along the upper surface of the base and are threaded through the cord opening and then extend rearwardly to the attached at transversely spaced apart locations proximate to a rear edge of the base. A dividing web may separate the two cord sections as they extend through the cord opening.

The cord used to attach the golf ball to the base is also formed as a safety cord. Here, an outer sleeve surrounds an inner core so that the outer sleeve defines a primary restraint on the flight of the golf ball. The outer sleeve may be formed of a nylon or other suitable material, and it is preferred that the sleeve can stretch, for example, to about one hundred thirty percent (130%) of its at rest length. The inner core, on the other hand, provides a safety restraint that is operative to restrain the flight of a golf ball upon failure of the outer sleeve. The inner core is preferably formed as a plurality of strands of material having a selected strand length that is longer than the sleeve but which are knitted into a core length that is less than the strand length. Upon failure of the outer sleeve, the inner core operates to unravel thereby to dampen or attenuate the flight of the golf ball until the flight reaches a distance equal to the strand length. This inner core may be knit lock nylon.

It is preferred that the base be formed as a forward platform and a rearward recess which together define an upper surface of the base with the recess having a transversely extending upright forward wall provided with a pair of spaced apart first openings and with the platform having a cord opening formed therethrough. Here, a cord is formed by an elongated cord folded about itself to form a distal loop that secures the golf ball and a pair of cord sections as described above. The cord sections are thus trained forwardly across the upper surface of the platform and are threaded through the opening after which they are trained rearwardly along a lower surface of the base underneath the platform. Each cord section then extends through a perspective first opening so that they are trained across an upper surface of the recess until they are attached at spaced apart transverse locations defined by a plurality of transversely oriented lacing holes. Here, the attachment locations are spaced apart further than the distance of spacing between the first openings so that the cord sections are rearwardly divergent in a V-shaped orientation. The platform may have a platform recess located opposite its top surface so that the cord sections are trained in this platform recess. A plurality of longitudinal ribs may be located in the platform recess to define one or more channels through which the cord sections may be trained.

These and other objects of the present invention will become more readily appreciated and understood from a consideration of the following detailed description of the exemplary embodiments when taken together with the accompanying drawings, in which:

DETAILED DESCRIPTION OF THE EXEMPLARY EMBODIMENTS

Figure 1:
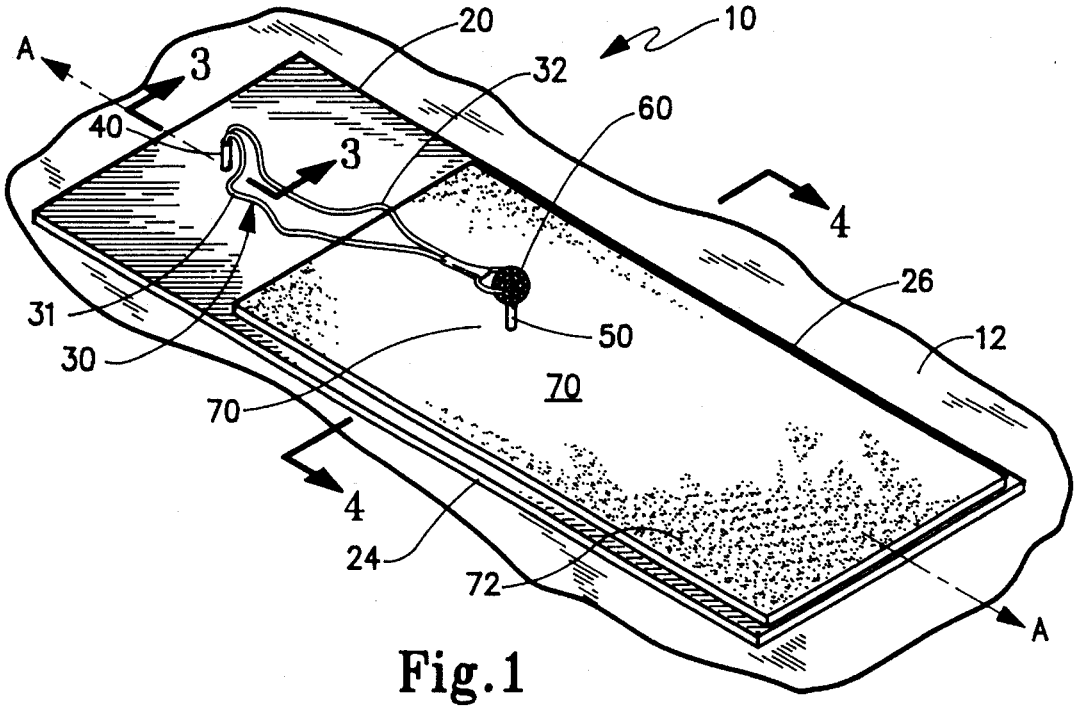
FIG. 1 is a perspective view of a golf swing practice device according to a first exemplary embodiment of the present invention including a tethered golf ball and mat assembly.

The present invention is directed to a golf swing practice device that aids a golfer in improving his/her game. To this end, the present invention is a portable, reusable device that permits a golfer to practice virtually anywhere, indoors or outdoors. It should be understood that this device allows the golfer to determine by the movement of the device the type of hit made and the direction that the ball takes in flight. For example and as described below, for a right-handed golfer, if the device moves to the right, the stroke was a hook, if the device moves to the left, the stroke was a slice, if the device moves directly forward and back the stroke was straight. Broadly, the invention includes a base, an elongated cord secured to the base, a golf ball tethered to the base by the cord and, importantly, a protective structure to reduce cord abrasion.

An exemplary embodiment of the present invention is best shown in FIGS. 1–5 and 7–10 wherein it should be appreciated that the practice device 10 of the present invention includes a base member 20 and a tethered golf ball 60 attached to the base member 20. More specifically, as is shown in these figures, cord 30 tethers golf ball 60 securely to the base member 20. The cord 30 extends from the lower surface 22 of the base member 20 through upright resilient member 40 to a free distal end that attaches golf ball 60. Resilient member 40 acts as a protective structure to reduce abrasion to cord 30 caused by repeated striking of golf ball 60. Cord 30 is sufficiently long so that the tethered golf ball 60 can be mounted on a tee structure 50 or directly on the drive area 70 depending on the type of shot being practiced. For example, a tee shot often hit with a driver would normally be practiced by employing the tee structure 50; a fairway shot, often hit with an iron or fairway used would normally be practiced without the tee structure 50, although the golfer may employ any desired club with any selected placement of golf ball 60.

Figure 2:
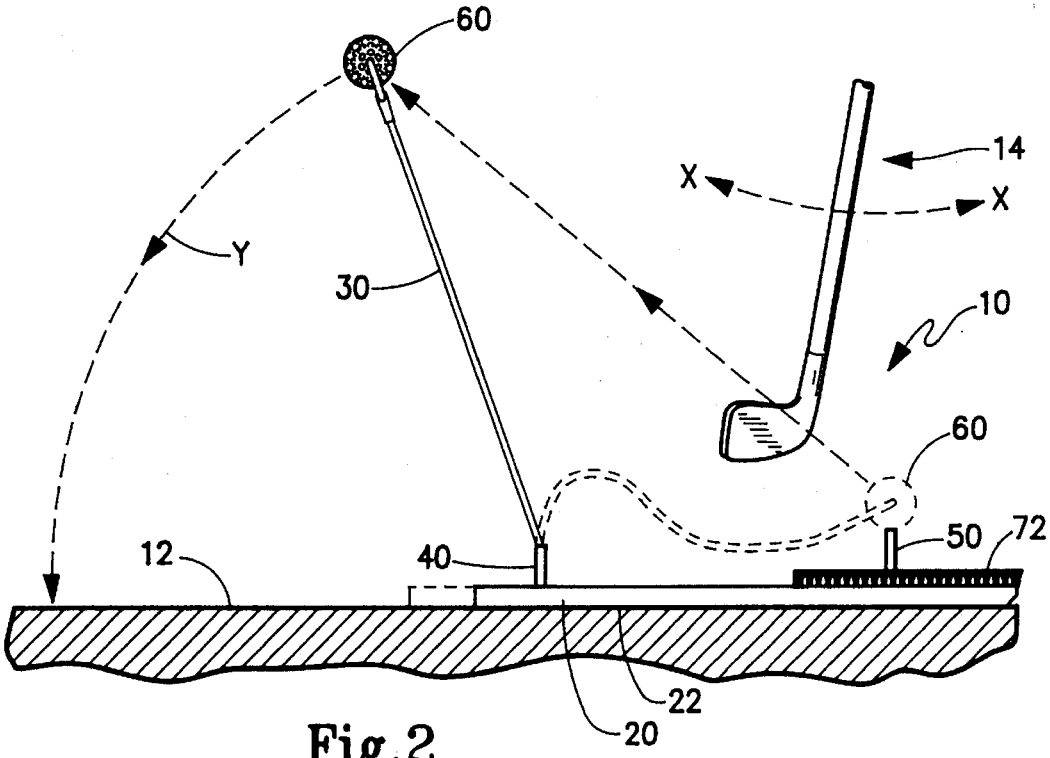
FIG. 2 is a side view in elevation of the front portion of the golf swing practice device of FIG. 1 showing the flight of the golf ball after being struck by a golf club.

With reference to FIGS. 1 and 2 the use of the device can be readily envisioned. In FIG. 1, the tethered golf ball 60 is positioned on the tee structure 50. A right handed golfer would position himself/herself approximately twenty-four inches (50 cm) to the left of the tee structure 50 with his/her feet being substantially parallel with left edge 24. Alternatively, a left handed golfer would position himself/herself the same distance away from the tee on the opposite side of the device with his/her feet parallel to right edge 26. As is shown in FIG. 2 the golf club 14 moving forwardly in the arc "X" strikes the golf ball 60, and the golf ball 60 will fly forward until it is restrained by the cord 30; it will then arc to the support surface 12 in the direction of arrow "Y". The base member 20 moves slightly forward with the force and pull of the ball 60. The movement of base member 20 will be in the direction of the flight path of the ball 60. Therefore, if the ball is hooked or sliced, the base member 20 will move forward at an angle to the longitudinal axis A. If the hit was straight the force of the ball to moves forward about one inch (2.5 cm) along axis A as shown in phantom in FIG. 2. Upon striking the ground, the golf ball 60 will bounce and usually recoil toward the tee structure 50. The force of the recoil is such that the base member 20 moves substantially back to its first position.

Figure 3:
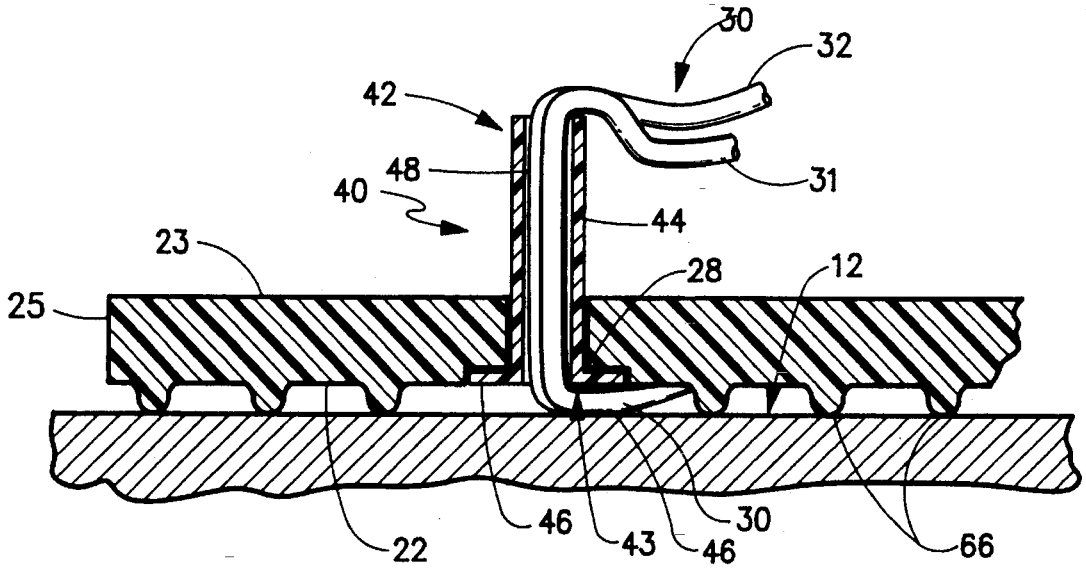
FIG. 3 is a cross-sectional view taken about lines 3—3 of FIG. 1.

Upright member 40 is best shown in FIGS. 1 and 3 where it may be seen that upright member 40 is located proximately to the forward edge 25. The upright member 40 is constructed of a resilient material and is preferably an integral one piece member having a top portion 42, a shaft 44, and a bottom portion 43. The bottom 43 is formed as a radial flange 46 which is located opposite of the top 42 of the upright member 40 and abuts the lower surface 22. A passageway way 48 extends through the upright member 40 from the bottom 43 through the shaft 44 to the top portion 42. The upright member 40 is mounted through a first opening 28 that extends through base member 20 from lower surface 22 to the upper surface 23. Therefore, the passageway 48 extends through the base member 20 and the upright member 40 from the lower surface 22 of the base member 20 to the top 42 of the upright member 40.

As can also be seen in FIG. 2 that cord 30 is formed by a pair of cord sections 31 and 32. Referencing both FIGS. 1 and 2, it can be seen that the upright member 40 retains the cords 30 and acts as a shock absorber for absorbing some of the force exerted on the golf swing practice device 10 when the ball 60 is struck and is pulled short from continuation of its flight path because the length of tethered cord 30 is fully extended. Because a golfer will strike a golf ball with a club such that the golf ball travels at speeds which reach over 100 mph, it is necessary that the resilient upright member 40 reduce the stress placed by the cord 30 on the ball 60. The upright resilient member 40 is structurally configured to: 1) absorb the force from the ball so that the cords 30 do not wear or abrade significantly; and 2) to restrain the cords 30 thus limiting the movement of the base member 20 along the support surface 12.

Figure 4:
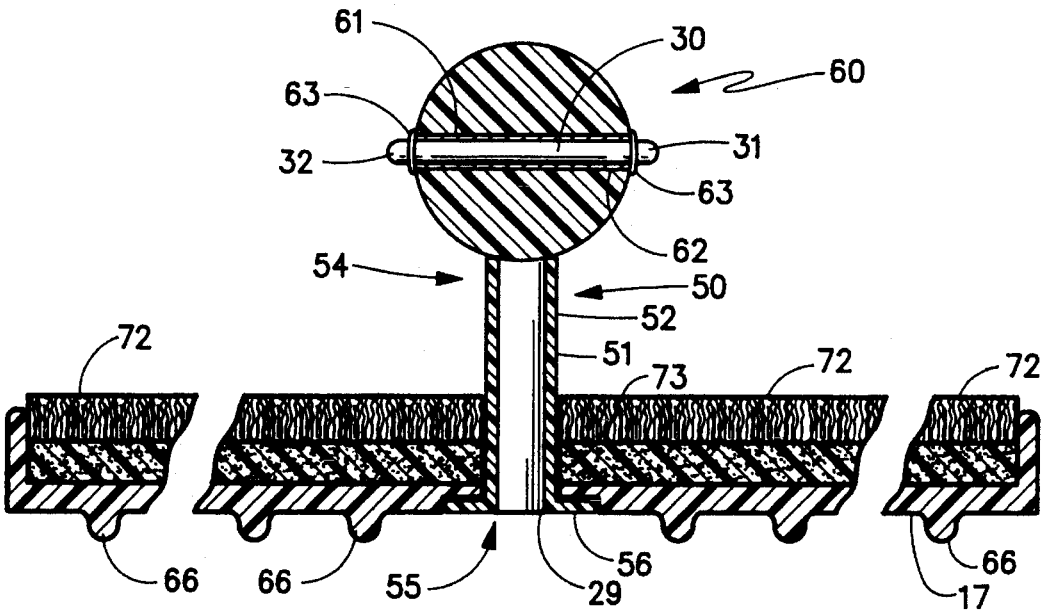
FIG. 4 is a cross-sectional view taken about lines 4—4 of FIG. 1.
Figure 8:
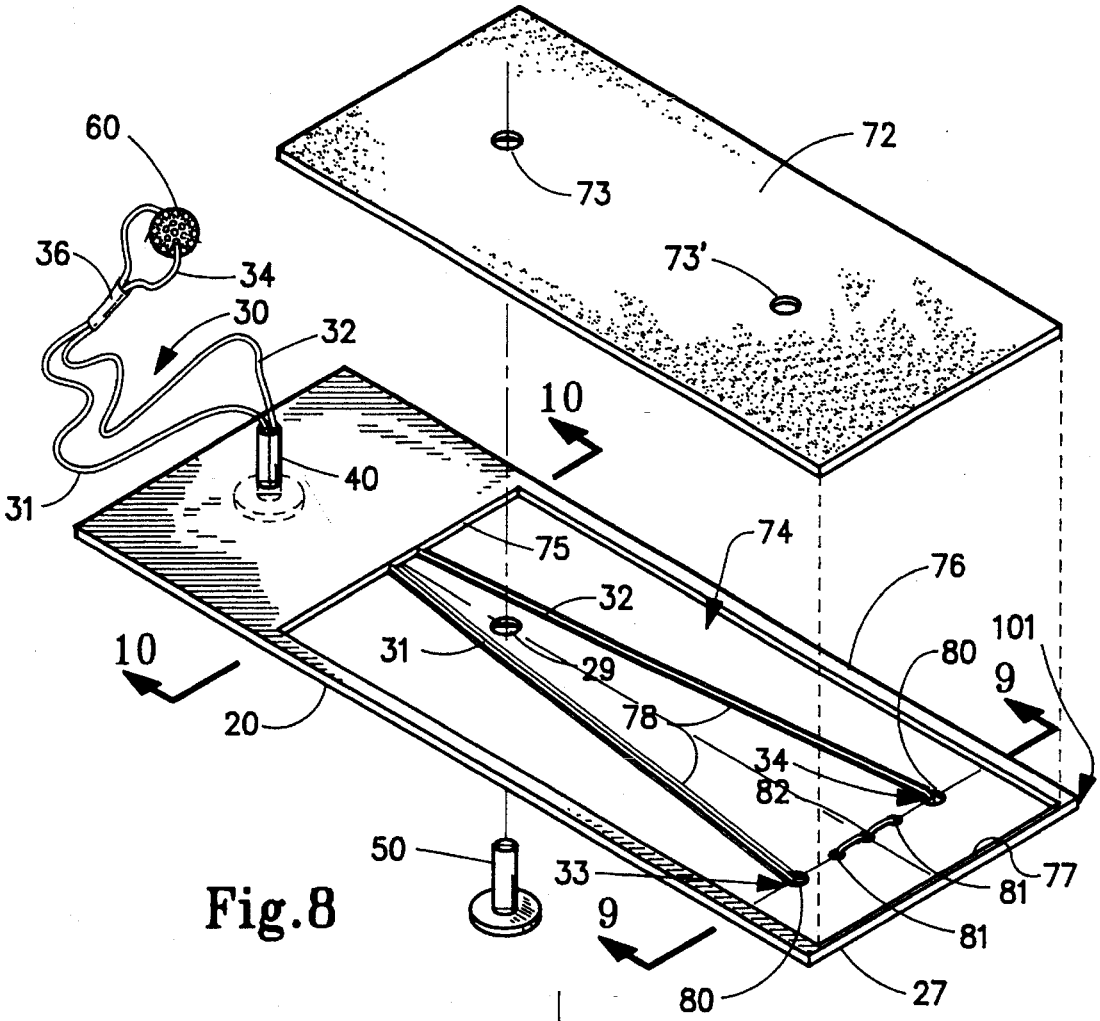
FIG. 8 is an exploded perspective view of the golf swing practice device shown in FIG. 1 illustrating the cord attachment to the base member.

With reference to FIGS. 1, 2 and 4, it can be readily seen that in the first exemplary embodiment of the present invention, a turf panel 72 is disposed on drive area 70 is located in a recessed area 74 in base 20 (as best shown in FIG. 8). Thus, the resilient member 40 is located at a location that is spaced from the drive area 70. Tee structure 50 projects upwardly from turf panel 72 medially of lower surface 22. The tee structure 50 has a lower radial tee flange 56, a tee shaft 52 with a surrounding tee side wall 51, a tee top portion 54 and a tee bottom portion 55. Base member 20 has a second opening 29 in the bottom wall 17 that is associated and registers with an opening 73 in the turf panel 72. The tee structure 50, which is removable, is inserted through the second opening 29 and the opening 73 so that the tee flange 56 rests abuts the lower surface 22 and so that a portion of the tee shaft 52 projects upwardly from turf panel 72, thus permitting the golf ball 60 to be mounted on the tee top 54.

Figure 5:
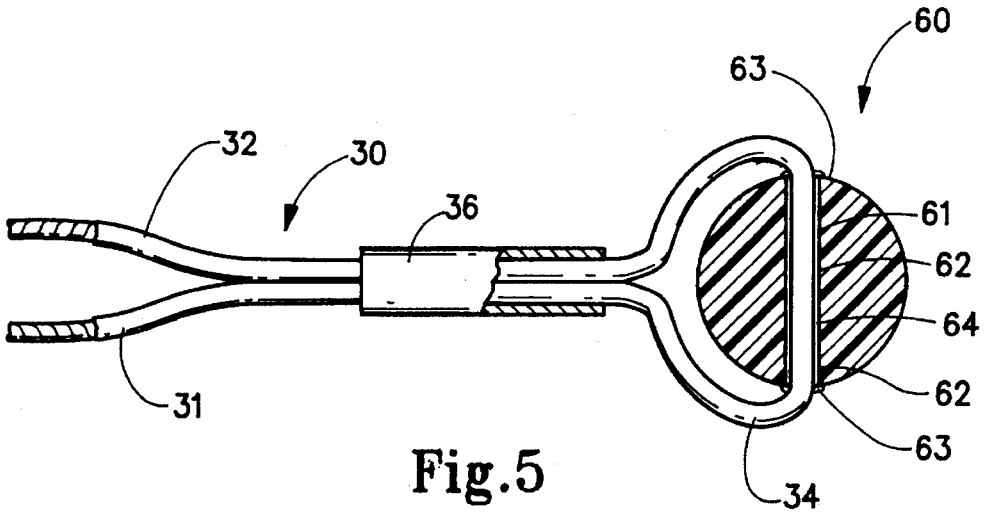
FIG. 5 is a top plan view, in partial cross-section, showing a first embodiment of a golf ball with attachment structure used according to the present invention.

The preferred structure of golf ball 60 is best shown in FIGS. 4 and 5 where it may be seen that golf ball 60 has a diametric bore 61 drilled or formed therethrough, and a molded plastic sleeve 62 is either inserted or molded integrally with golf ball 60. Sleeve 62 has a pair of enlarged heads 63 which engage the outer surface of golf ball 60 so as to retain sleeve 62 in diametric bore 61. Sleeve 62 has a longitudinal passageway 64 through which a looped portion of cord 30 is threaded. Golf ball 60 is preferably formed of a single piece high-impact polymer, having a durometer value of approximately ninety on the D-scale. Such ball construction is known in the art, and these balls are typically employed as the standard range ball. Correspondingly, sleeve 62 is formed of polyester with about two percent (2%) silicon to provide lubrication for durability, and sleeve 62 has a durometer value of about one hundred. By selecting the durometer value of sleeve 62 to be larger than the durometer value of golf ball 60, greater cord life is obtained and there is less abrasion of cord 30 by rounded heads 63.

Figure 9:
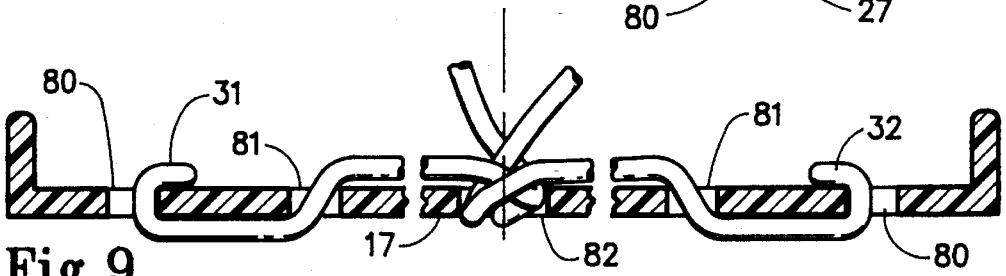
FIG. 9 is a cross-sectional view taken about lines 9—9 of FIG. 8.
Figure 10:
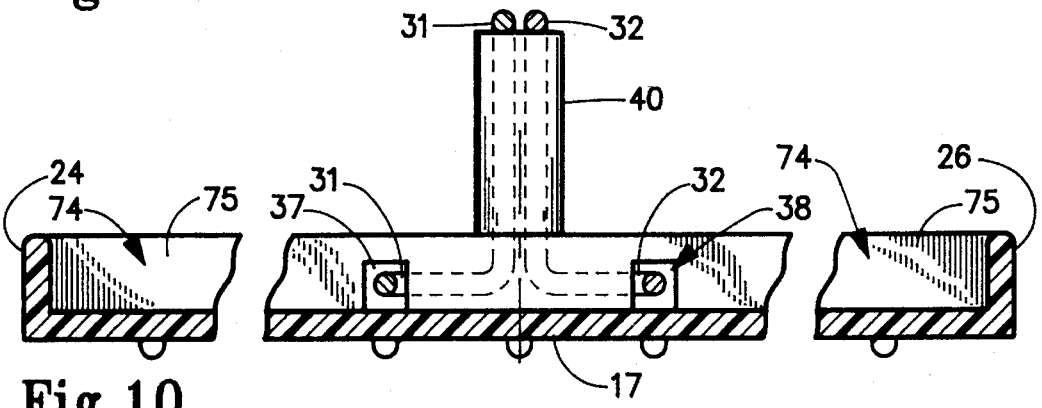
FIG. 10 is a cross-sectional view taken about lines 10—10 of FIG. 8.
Figure 11:
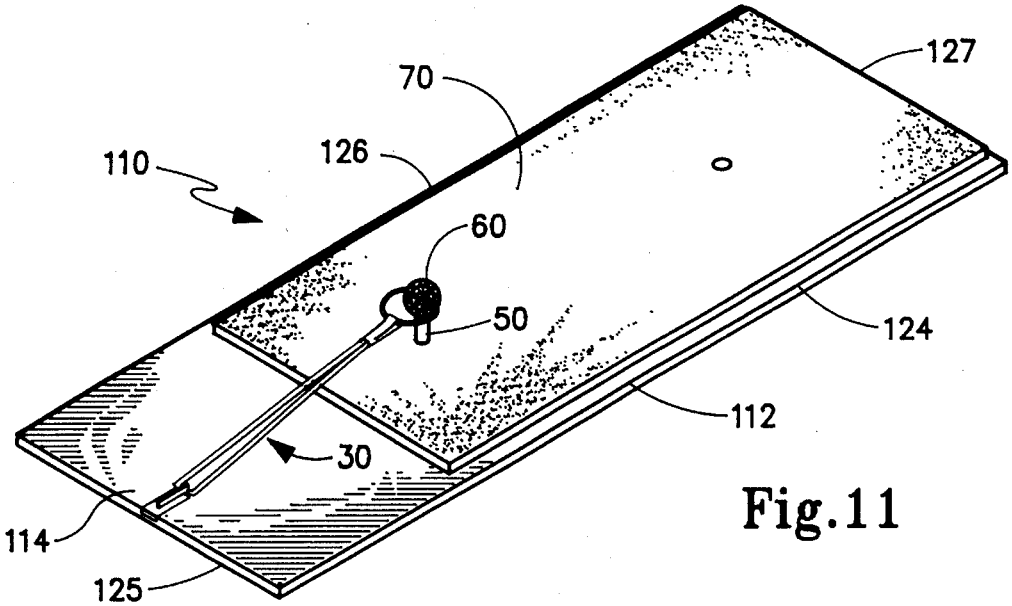
FIG. 11 is a perspective view of an alternative exemplary embodiment of the golf swing practice device according to the present invention.

With reference to FIGS. 1, 5 and 8, it may be seen that cord 30 is an elongated cord that is preferably doubled upon itself to define cord loop 34, thus forming the first and second cord sections 31 and 32. Loop portion 34 is secured by means of a slidably clip 36 so that loop portion 34 is in the form of an adjustable york upon which golf ball 60 is retained. Thus, york or loop 34 defines a distal end for cord 30 while the ends of cord sections 31 and 32 opposite loop 34 form proximal ends which are secured relative to base 20. As is best shown in FIG. 8, this is accomplished by threading cord sections 31 and 32 through resilient member 40 and outwardly from a pair of holes 37 and 38 formed in front wall 75 of recessed portion 74 and lacing the proximal ends of cord sections 31 and 32 through a plurality of lacing holes located proximately to rearward edge 27 of base 20. These lacing holes are aligned with one another in a transverse direction of base 20 and include an outer pair of holes 80, an inner pair of holes 81, and a central hole 82. As is shown in FIGS. 8 and 9, cord sections 31 and 32 exiting holes 37 and 38 are trained rearwardly across the upper surface of recess 74 and have their respective proximal end portions threaded downwardly through outer holes 80 and back through holes 81 where they are secured, such as by knotting, in central hole 82. Holes 80 are spaced apart from one another in the transverse direction a selected distance so that the effective mounting locations of the distal ends of cord sections 31 and 32 are at 33 and 34, respectively. Since holes 37 and 38 in front recess wall 75 are spaced closer to one another than are holes 80, cord sections 31 and 32 diverge in a V-shaped configuration rearwardly of holes 37 and 38.

Figure 7:
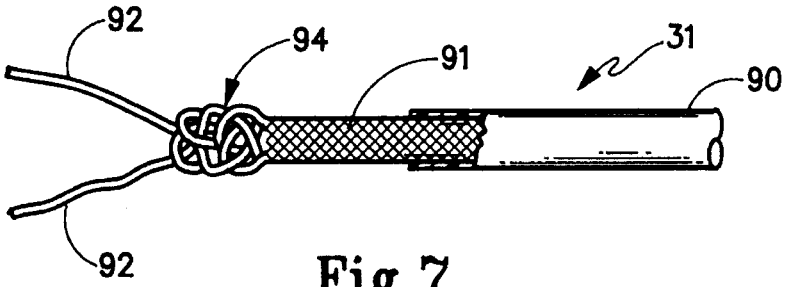
FIG. 7 is a side view, in partial cross-section, showing the construction of the safety cord used with the present invention.

With reference to FIG. 7, it may be seen that cord 30 and, representative cord section 31 shown in FIG. 7 is of special construction wherein an outer sleeve 90 encases an inner core 91 formed by a pair of woven strands 92. This cord is available from Neocorp located in East Providence, R.I., and provides a safety feature of the present invention not heretofore utilized in golf practice devices. Specifically, sleeve 90, which is preferably constructed of nylon, provides the primary restrain on the flight of golf ball 60. Inner core 91 provides a secondary or safety backup cord which only becomes effective should sleeve 90 break or abrade. Upon the failure of sleeve 90, which preferably is stretchy or elastic to approximately at least one hundred thirty percent (130%) of its at rest length, strands 92 begin to unravel, as is shown by unraveling mass 94'. That is, these strands begin to "unlock" due to their weave. Since the knitting of strands 92 resist the unraveling, the flight of the golf ball is attenuated, i.e., dampened, until core 91 unravels the full effective length of strands 92, which are approximately three times the length of sleeve 90. Thus, the golf ball may fly a further distance than allowed by cord 30 when sleeve 90 is not abraded, but the energy of the ball is dissipated before impact. This protects both the golfer, person surrounding the golfer and property from damage.

Figure 6A:
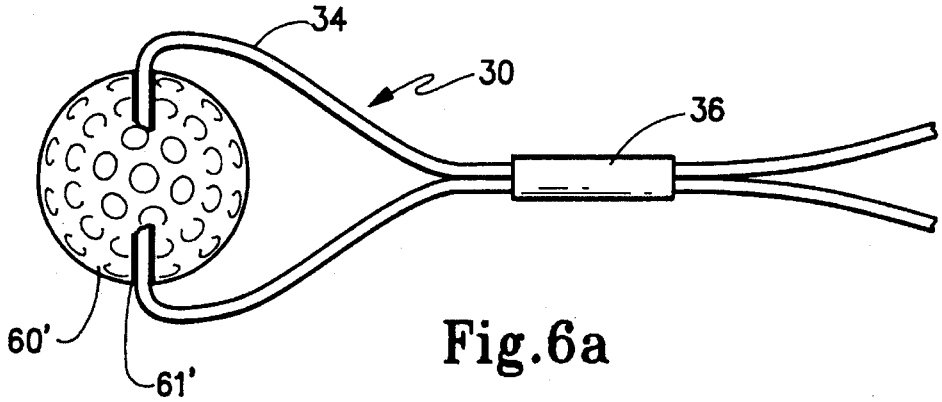
FIGS. 6(*a*) and 6(*b*) are top plan views in partial cross-section, similar to FIG. 5, but showing alternative golf ball attachment structures.
Figure 6B:
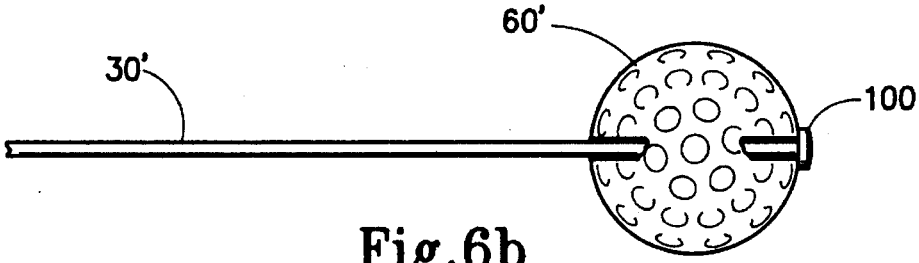

Alternative structures of the golf ball 60 and cord 30 are shown in FIGS. 6(*a*) and 6(b). With reference to FIG. 6(*a*), it may be seen that cord 30 is simply inserted through a diametric bore 61' formed through a golf ball 60'. Thus, loop 34 extends directly around the golf ball 60' with sleeve 62 being eliminated. As is noted above, this structure will work with the present invention although loop 34 will be subjected to greater abrasive forces and golf ball 60' may tend to break apart more readily due to the lack of buffering sleeve 62. In FIG. 6(*b*), a second alternative structure is used where a single cord 30' extends through diametric bore 60' to terminate at a plastic head 100 that retains ball 60' on cord 30'. This structure, while also working with the present invention has additional disadvantages. Again, the ball may be subjected to greater forces to break it apart and cord 30' may be subjected to more abrasion. Moreover, should clip 100 disengage from cord 30', ball 60' may fly off of cord 30' when the ball is struck by a golf club. Moreover, by eliminating the loop or yoke 34, ball 60' is not as balanced in its flight so a less true feel is given to the golfer utilizing the practice device.

A golf ball with solid core such as a range ball tethered as shown in FIG. 5 averages about one thousand hits if it is hit with one of the golfer's drivers, a fairway wood or with an iron. However, if the ball is tethered as shown in FIGS. 6(*a*) and 6(*b*) the average life of the ball substantially decreases. Thus it is preferred that the distal end 32 of the cord 30 be formed as two strands that form a loop 34 that pass through a diametrical bore 64 in the golf ball 60 and that sleeve 62 be utilized.

FIG. 8 shows a view of the base member 20 and the drive area 70 when the turf panel 72 is removed and a recessed portion 74 is viewed. In FIG. 6 the turf panel 72 is approximately one-half inch in height and is sized to fit within recess 74 which is surrounded by rim 76. The turf panel 72 can be securely attached into recess 74, however it is preferred that turf panel 72 simply be located in the recess 74 without being permanently secured. Turf panel 72 has a second opening 73' so that, when the area surrounding opening 73 becomes worn, panel 72 can be rotated to register opening 73' with opening 29. When the turf panel 72 becomes worn around both openings 73, 73' or is otherwise ripped or torn due to the golfer taking divots when striking the tethered golf ball 60, the turf panel 72 can simply be removed and replaced. Likewise, the ability to remove turf panel 72 allows ready access to the proximal ends of cord sections 31 and 32 which are secured to the base member 20. Thus if cord 30 becomes worn, if the tethered golf ball 60 starts to deteriorate or if the clip device 36 breaks then the tethered ball 60 can be readily replaced with a new ball or a new cord with its associated tethered golf ball.

Within the recess portion 74 of FIG. 6 there are a pair of longitudinally extending grooves 78 to receive cord sections 31 and 32. The grooves 78 diverge from the front wall 75 of the recess 74 along the upper surface of recess 74 toward the back wall 77 of recess 74. Proximate the rearward end 27, each of the grooves 76 communicates with the cord openings 80. At forward wall 75, these grooves communicate with holes 37 and 38. With reference to FIGS. 1, 2, 8 and 10, it can be seen that the cord 30 runs through said upright member 40 underneath the base member 20 to the front wall 75 of the recess 74. The cord 30 diverges from upright member 40 in a V-shape as shown in phantom. The cord 30 passes from the front wall 75 through holes 37 and 38 and into the recess 74 where it lies in the pair of diverging grooves 78. The cord 30 is then secured to the base member 20 by lacing it through openings 80–82.

Cord 30 is preferably made of the construction shown in FIG. 7, other constructions are possible. The cord may be made of a nylon material since nylon material is substantially more resilient then most other cord material. Although other cord material can be used in the present invention, other cords tend to result in less longevity of the tethered ball, and thus the nylon cord is preferred. The length of the cord in combination with the material of which the cord is formed, both are operative to reduce the stress on the golf ball and thus increase the longevity of the tethered golf ball. Further, having at least seven (7) foot and preferably eight (8) foot of double strand cord permits the cord to absorb some of the force of the ball when struck and when recoiling. The eight (8) foot cord also results in a decreased movement of the base member 20 along the support surface 12 when the golf ball 60 is struck.

FIG. 4 also clearly shows a plurality of cleats which are formed on the lower surface 22 of the base member 20. The cleats 66 can be located oppositely the recessed portion 74 on lower surface 22; or alternatively, the entire lower surface 22 can be provided with cleats 66. These cleats 66 are preferably formed of a polyethylene material integrally with base 20. A variety of polymeric, plastic materials which are equally lightweight and durable and can be employed for base 20 and cleats 66, however, forming cleats 66 of a plastic material allows the device 10 to be utilized both indoors on carpet and outdoors in the grass.

Figure 12:
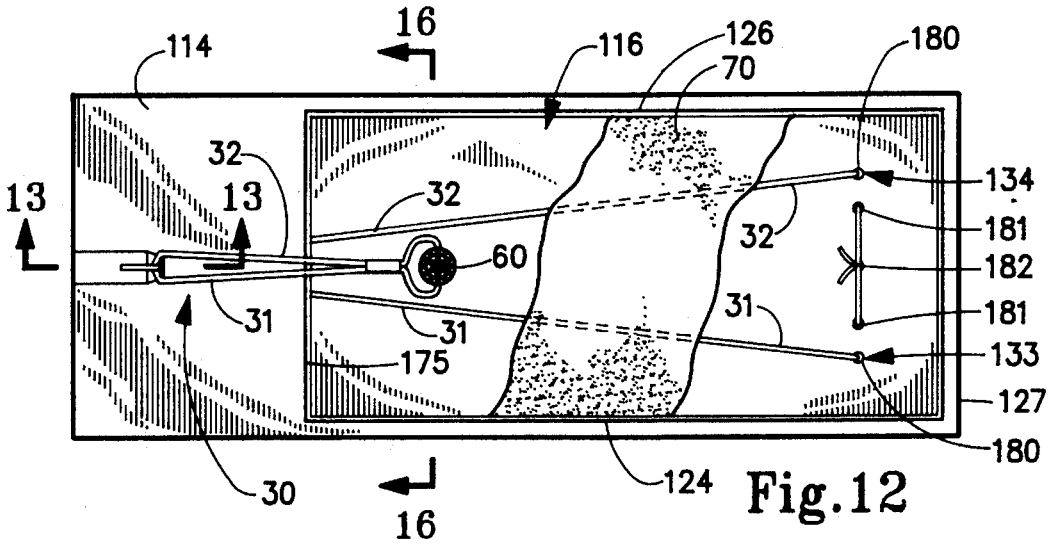
FIG. 12 is a top plan view, partially broken away, showing the golf swing practice device of FIG. 11.

An alternative exemplary embodiment of the present invention is shown in FIGS. 11–16, and it should be understood that substantial portions of this structure are the same as that described with respect to the first embodiment of the invention. In this Figures, golf swing practice device 110 includes a base 112 which has a forwardly located platform 114 and a rearwardly located recess 116. Recess 116 mountably receives artificial turf pad 70 therein between side walls 124 and 126 and rearward end wall 127 and forward wall 175. Base 112 supports a tee structure 150 onto which a golf ball 60 may be positioned for striking with the golf club. Golf ball 60, of the structure described above, is tethered by means of a cord 30, also as described above, which includes a pair of cord sections 31 and 32 which, as is shown in FIG. 12, are trained across the upper surface of recess 116 and diverge from one another in the rearward direction to be secured through lacing holes 180, 181 and 182. A tee structure 50 may selectively be inserted from the underside of base 112 through hole 129 formed in bottom 117 of recess 116. Tee structure 50 includes a radial flange 56 to accomplish this mounting. Bottom wall 117 defines a lower surface 122 for base 112, and lower surface 122 may be provided with a plurality of cleats, such as cleats 166 shown in FIG. 14.

Figure 16:
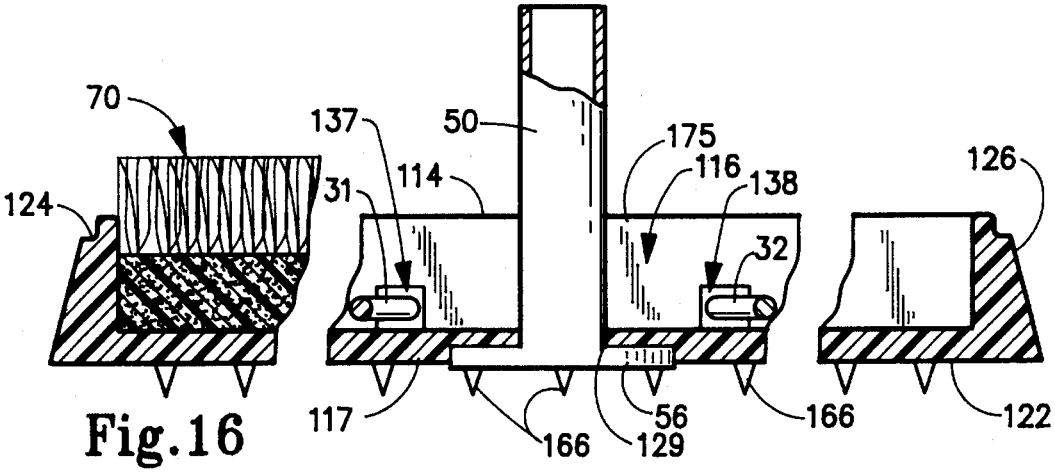
FIG. 16 is a cross-sectional view, taken about lines 16—16 of FIG. 12 but with the golf ball being removed from the tee.
Figure 14:
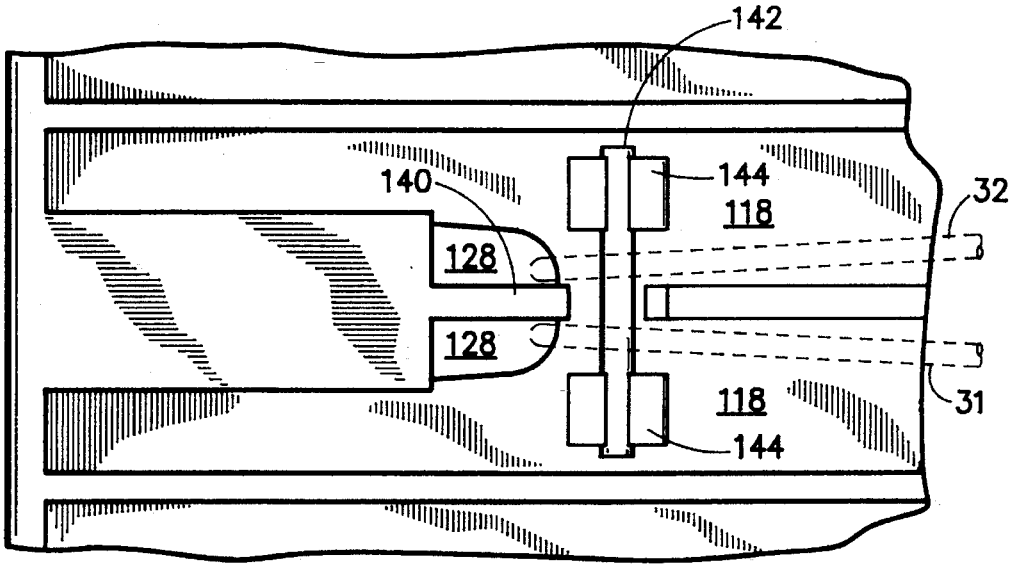
FIG. 14 is a top plan view of the cord opening shown in FIG. 13.
Figure 15:
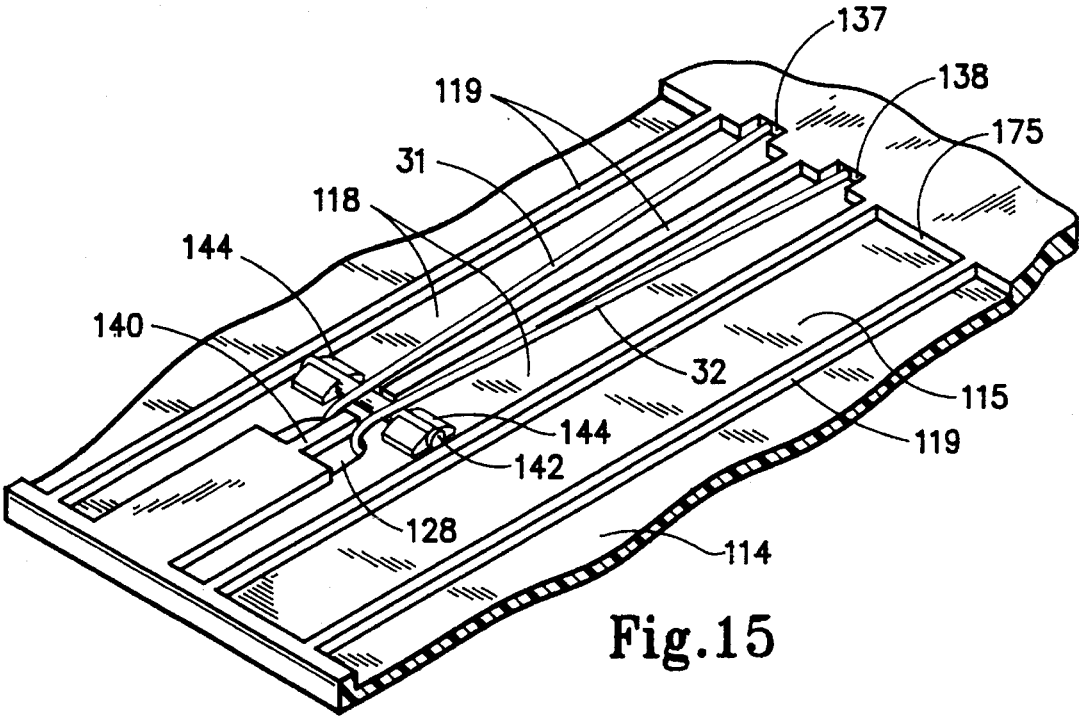
FIG. 15 is a bottom view, in the perspective, of the forward portion of the golf swing practice device of FIG. 11.

With reference to FIGS. 12, 15 and 16, it may be seen that cord sections 31 and 32 extend forwardly through openings 137 and 138 in front recess wall 175 so they extend along the undersurface of platform 114 where they extend upwardly through a cord opening 128 located proximately to front edge 125 of base 112. Cord opening 1287 is thus spaced from the drive area located above recess 116 and turf pad 70 disposed therein. As shown in FIGS. 14, 15 and 16, hole 128 is bifurcated by means of an upright web 140 so that cord sections 31 and 32 are separated from one another by web 140 as a medial portion thereof are threaded upwardly through opening 128. As is shown in FIG. 15, platform 114 has a downwardly opening recess 115 reinforced by a plurality of ribs 119 the innermost three of which form channels 118 through which cord sections 131 and 132 may extend.

Figure 13:
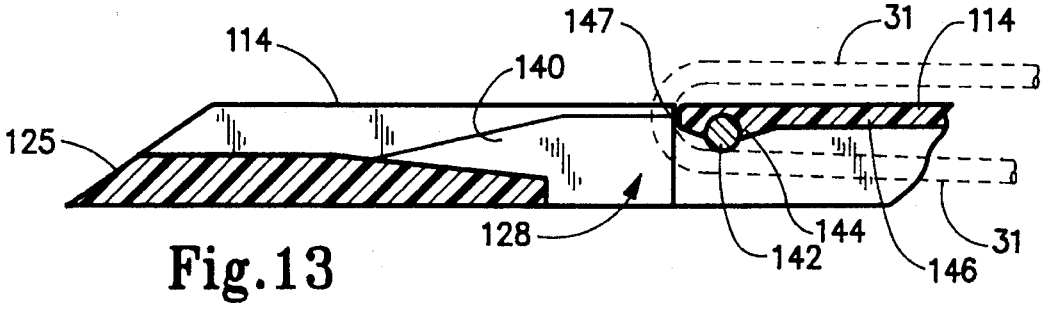
FIG. 13 is a side view in cross-section taken about lines 13—13 of FIG. 12 and showing the cord opening at the forward end of the golf swing practice device of FIG. 11 along with the transverse protecting rod.

A different protective structure is used with golf swing practice device 110 according to this second embodiment. Instead of utilizing an upright resilient member 40, this second embodiment employs a transversely oriented steel rod 142 which is retained by a pair of pillow blocks 144 spaced laterally apart from one another on opposite sides of opening 128. As shown in FIG. 13, top wall 146 which defines platform 114 terminates in a forward edge 147 that is rounded at a radius of curvature corresponding to the radius of curvature of rod 142. Thus, when cord sections 31 and 32 are threaded therearound, cord sections 31 and 32 are protected against abrasion by this radius of curvature. Rod 142 is provided to prevent cord sections 31 and 32 from wearing into edge 147 by rigidifying edge 147 and providing a harder material (e.g., steel) over which the cord section extend. It has been found that this structure is somewhat superior as a protective structure than that described with respect to golf swing practice device 10.

Figure 17:
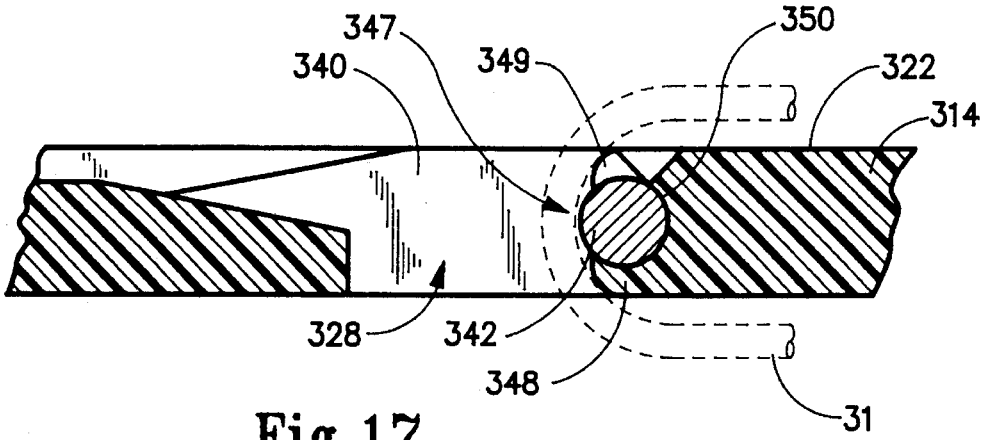
FIG. 17 is a cross-sectional view similar to FIG. 13 and showing an alternative mounting structure for the transverse protecting rod.

An alternative embodiment of the transverse rod protective structure according to the present invention is shown in FIG. 17. Here, it may be seen that platform 314 terminates in a forward edge 347 defined by a pair of jaws 348 and 349. Jaws 348, 349 define a transverse channel 350 having a radius sized to snugly fit cylindrical rod 342 therein so that rod 342 forms the extreme forward edge 347 of deck 314 over which the cord sections, such as cord section 31 is trained. Accordingly, bifurcating web 340 which separate opening 328 into the respective portions to receive cords 31 and 32, includes a hole sized so that transverse rod 342 may extend therethrough. The opposite ends of transverse rod 342 may similarly extend in holes formed in the reinforcing ribs (not shown), similar to ribs 119 of FIG. 15. The embodiment shown in FIG. 17 thus has all of the advantages of the transverse rod shown in FIGS. 11–16 but further insures that the cord contacts the metal-sliding surface formed by the exposed circumferential surface of rod 342.

Figure 18A:
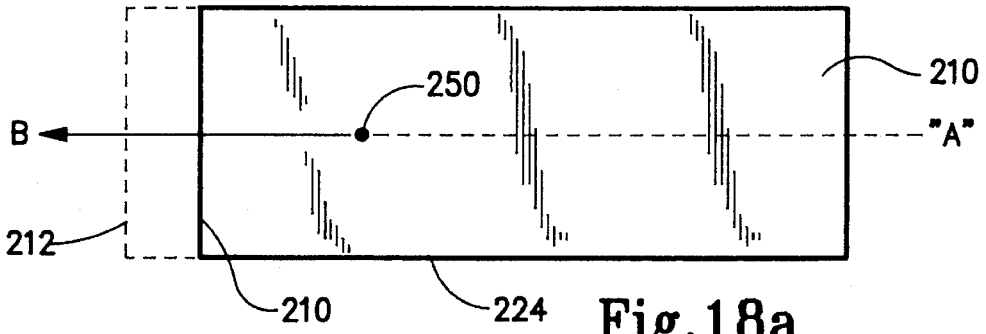
FIGS. 18(*a*), 18(*b*) and 18(*c*) are diagrammatic views showing the response of the golf swing practice devices according to the exemplary embodiments of the present invention upon being employed by a golfer with correct and errant hits.
Figure 18B:
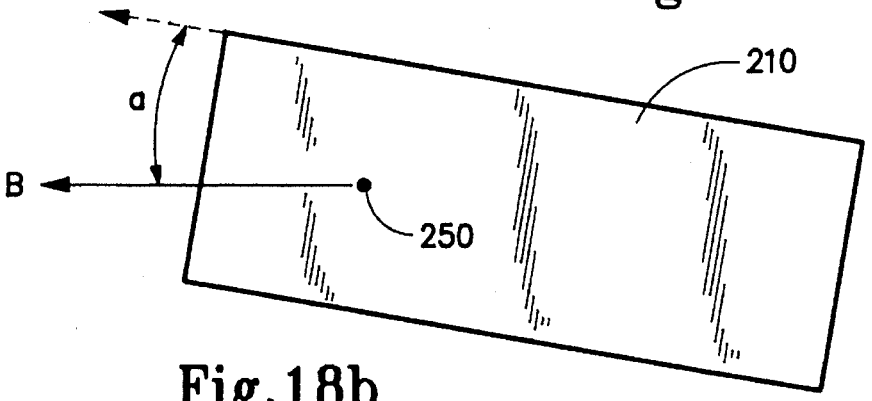
Figure 18C:
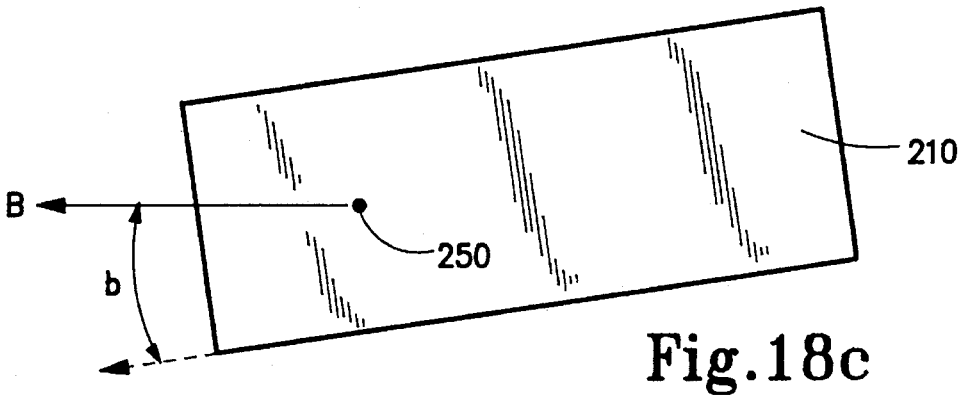

In any event, both of golf swing practice devices 10 and 110 are believed to perform in a superior manner to those previously known. Not only do each of these devices allow a golfer to experience the true feel of hitting a golf ball, but also each of these devices help register whether the golfer has properly stroked the ball. This can be seen in reference to FIGS. 18(*a*)–18(*c*). FIG. 18(*a*) shows a representative device 210 (which may either be device 10 or 110) oriented in a forward direction "B" aligned with its longitudinal axis "A". As noted above, if a ball, located at tee location 250 is properly struck, device 210 will initially bring forward one to two inches, to approximately the position shown in phantom 212, but rebound to its original position wherein edges 224 and 226 are parallel to the longitudinal axis "A".

However, if a right handed golfer slices the golf ball or a left handed golfer hooks the golf ball, then the orientation of mat 210 will be as shown in FIG. 18(*b*). Here, it may be seen that mat 210 is canted and angle "a" with respect to the intended direction "B" due to the mis-hit of the ball. Angle "a" approximates the deviation angle with which the ball would have flown had it not been tethered by the device. This is accomplished by having the proximal portions of cord sections 31 and 32 trained over the upper surface of the rearward portion of the respective base 20 or 120 of devices 10 and 110, respectively, and securing these cords at effective locations transversely spaced apart from one another as designated locations 33 and 34 in FIG. 8 or 133, 134 in FIG. 12. Similarly, with reference to FIG. 18(*c*), it may be seen that, if a right handed golfer hooks the golf ball, or a left handed golfer slices the golf ball, mat 210 will come to rest at a position that is canted in angle "b" with respect to the intended direction of flight "B". Again, angle "b" proximities the direction of flight of the mis-struck golf ball.

In order to produce the results shown in FIGS. 18(*a*)–18(*c*), it has been found that the weight of the golf swing practice device should be in excess of six pounds. Moreover, it has been found that the device performs adequately up to a weight of approximately twenty pounds, although it is preferred that the golf swing practice device weigh approximately eight (8) pounds (3.6 Kg).

Accordingly, the present invention has been described with some degree of particularity directed to the exemplary embodiments of the present invention. It should be appreciated, though, that the present invention is defined by the following claims construed in light of the prior art so that modifications or changes may be made to the preferred embodiment of the present invention without departing from the inventive concepts contained herein.

I claim:

1. A golf swing practice device adapted to be positioned on a support surface whereby a golfer may practice striking a golf ball with a golf club to impart flight thereto, comprising:

(a) a base having a lower surface adapted to be positioned on the support surface and an upper surface located oppositely of the lower surface, said base having a drive area located on the upper surface;

(b) an elongated cord secured relative to said base member and having a portion thereof extending a selected distance from a first location spaced from the drive area so that said cord can extend across the upper surface to terminate at a distal end that is positionable above the drive area;

(c) a golf ball secured to the distal end of said cord whereby said golf ball is tethered to said base; and (d) an upright resilient member located proximately to the first location and operative to support said cord against abrasion caused by repeated striking of said golf ball secured thereto, said resilient member extending upwardly from said upper surface to terminate in a top portion.

2. A golf swing practice device according to claim 1 wherein said resilient member has a hollow shaft providing an upright axial passageway extending therethrough from the lower surface to said top portion, said cord extending from the distal end locatable on the drive area, through the axial passageway and across the lower surface to be secured remotely from the axial passageway, said resilient member thereby operative to flex under a force applied by said cord as said golf ball is struck so that said cord is protected against abrasion.

3. A golf swing practice device according to claim 2 wherein said base has an opening formed therein at the first location, said resilient member being formed independently of said base so that it may be removably mounted through the opening in said base, said resilient member including a radially extending flange at a bottom portion opposite the top portion thereof and operative to abut the lower surface of said base when said resilient member is mounted thereto.

4. A golf swing practice device according to claim 1 wherein said golf ball has a diametric bore formed therethrough, said distal end of said cord being formed as a loop extending through the bore.

5. A golf swing practice device according to claim 4 including a tubular element received in the bore of said golf ball, said cord extending through said tubular element.

6. A golf swing practice device according to claim 5 wherein said golf ball has a selected durometer of hardness and wherein said tubular element has a durometer of hardness greater than the selected durometer of hardness of said golf ball.

7. A golf swing practice device according to claim 1 wherein said cord is formed as an outer sleeve surrounding an inner core, said outer sleeve defining a primary restraint on the flight of said golf ball and said inner core providing a safety restraint operative to restrain the flight of said golf ball upon failure of said outer sleeve.

8. A golf swing practice device according to claim 7 wherein said outer sleeve can stretch to at least one hundred thirty percent (130%) of its at rest length.

9. A golf swing practice device according to claim 7 wherein said inner core is formed of a plurality of strands of material having a selected strand length yet which are knit into a core length that is less than the strand length, said inner core operative to unravel upon failure of said outer sleeve thereby to dampen the flight of said golf ball until the flight reaches a distance equal to the strand length.

10. A golf swing practice device according to claim 9 wherein said inner core is formed of knit lock nylon.

11. A golf swing practice device according to claim 1 wherein said base weighs between six and twenty pounds (about 2.7 and 9 kilograms).

12. A golf swing practice device adapted to be positioned on a support surface whereby a golfer may practice striking a golf ball with a golf club to impart flight thereto, comprising:

(a) a base having a lower surface adapted to be positioned on the support surface and an upper surface located oppositely of the lower surface, said base having an opening formed therethrough and a drive area located on the upper surface;

(b) an elongated cord secured relative to said base member and including a lower portion extending alongside the lower surface, a medial portion extending through the opening in said base and an upper portion extending alongside the upper surface to terminate in a distal end, said upper portion of sufficient length so that the distal end is positionable above the drive area;

(c) a golf ball secured to the distal end of said cord whereby said golf ball is tethered to said base; and (d) a protective member located proximately to the opening and positioned to engage said medial portion of said cord that extends through said opening thereby to protect the medial portion of said cord against abrasion caused by repeated striking of said golf ball secured thereto.

13. A golf swing practice device according to claim 12 wherein said resilient element mountable to said base and including an upright hollow shaft having a top portion and a bottom portion, said shaft sized to be matably received in the opening and providing an axial passageway extending therethrough from the lower surface to said top portion with the medial portion of said cord extending through the axial passageway, said resilient element including a radial flange at a bottom portion operative to abut the lower surface of said base when said shaft is received in the opening, said shaft thereby operative to flex under a force applied by said cord as said golf ball is struck so that said cord is protected against abrasion.

14. A golf swing practice device according to claim 12 wherein said protective structure includes a rod mounted on the lower surface of said base adjacent to the opening transversely of said cord so that said cord is trained around said rod to protect said cord from abrasion against the opening.

15. A golf swing practice device according to claim 12 wherein said golf ball has a diametric bore formed therethrough, said distal end of said cord being formed as a loop extending through the bore.

16. A golf swing practice device according to claim 12 wherein said cord is formed as an outer sleeve surrounding an inner core, said outer sleeve defining a primary restraint on the flight of said golf ball and said inner core providing a safety restraint operative to restrain the flight of said golf ball upon failure of said outer sleeve.

17. A golf swing practice device according to claim 12 including an artificial turf panel disposed on said drive area.

18. A golf swing practice device according to claim 12 including a plurality of cleats disposed on the lower surface of said base, said cleats operative to engage the support surface whereby movement of said base along the support surface is resisted.

19. A golf swing practice device adapted to be positioned on a support surface whereby a golfer may practice striking a golf ball with a golf club to impart flight thereto, comprising:

(a) a base including a forward platform and a rearward recess together defining an upper surface of said base, said recess having a transversely extending upright forward wall provided with a pair of spaced-apart first openings and said platform having a cord opening formed therethrough;

(b) an elongated cord doubled on itself to define a distal cord loop and first and second cord sections which terminate respectively in first and second proximal end portions, said first and second end portions secured relative to said base member at first and second locations located rearwardly of said first openings and transversely spaced from one another so that each of said first and second cord sections extend forwardly from its respective first and second location alongside the upper surface in the recess, through a respective one of said first openings alongside a lower surface of said base opposite the upper surface and upwardly through the cord opening in said platform to terminate in said distal loop portion; and (c) a golf ball secured to the distal loop portion of said cord whereby said golf ball is tethered to said base, said first and second cord sections being of sufficient length so that said golf ball may be oriented above the recess.

20. A golf swing practice device according to claim 19 including a protective structure located proximately to the cord opening and operative to support said first and second cord sections against abrasion caused by repeated striking of said golf ball secured thereto.

21. A golf swing practice device according to claim 20 wherein said protective structure is a resilient element mountable to said base and including an upright hollow shaft having a top portion and a bottom portion, said shaft sized to be matably received in the cord opening and providing an axial passageway extending therethrough from the lower surface to said top portion with a medial portion of each of said cord sections extending through the axial passageway, said shaft operative to flex under a force applied by said cord as said golf ball is struck so that said cord is protected against abrasion.

22. A golf swing practice device according to claim 20 wherein said protective structure includes a transversely oriented rod mounted on the lower surface of said base adjacent to the opening so that each of said first and second cord sections are trained around said rod to protect said first and second cord sections from abrasion against the cord opening.

23. A golf swing practice device according to claim 19 including an artificial turf mat disposed in the rearward recess.

24. A golf swing practice device according to claim 19 wherein said base includes a tee structure disposed in the rearward recess.

25. A golf swing practice device according to claim 19 wherein said recess includes a bottom wall, said bottom wall having a plurality of transversely aligned holes located at a rearward portion thereof to define said first and second locations, said first and second proximal end portions of said first and second cords being laced through the aligned holes and fastened together thereby to secure said cord relative to said base.

26. A golf swing practice device according to claim 19 including a clip slidably disposed on said first and second cord sections adjacent to said distal cord loop, said clip operative to form a yoke of adjustable size.

27. A golf swing practice device according to claim 19 wherein said platform has a forward recess located oppositely the upper surface, said first and second cord sections extending alongside the lower surface within-said forward recess.

28. A golf swing practice device according to claim 27 wherein said forward recess includes a plurality of longitudinal ribs defining at least two channels, said first openings communicating with a respective channel whereby said first and second cord sections are received therein.

29. A golf swing practice device according to claim 19 wherein said golf ball has a diametric bore formed therethrough and including a tubular element received in the bore of said golf ball, said loop extending through said tubular element.

30. A golf swing practice device according to claim 19 wherein said cord is formed as an outer sleeve surrounding an inner core, said outer sleeve defining a primary restraint on the flight of said golf ball and said inner core providing a safety restraint operative to restrain the flight of said golf ball upon failure of said outer sleeve.

31. A golf swing practice device according to claim 30 wherein said inner core is formed of a plurality of strands of material having a selected strand length yet which are knit into a core length that is less than the strand length, said inner core operative to unravel upon failure of said outer sleeve thereby to dampen the flight of said golf ball until the flight reaches a distance equal to the strand length.

32. A golf swing practice device adapted to be positioned on a support surface whereby a golfer may practice striking a golf ball with a golf club to impart flight thereto, comprising:

(a) a base having a lower surface adapted to be positioned on the support surface and an upper surface located oppositely of the lower surface, said base having an opening formed therein at a first location and a drive area located on the upper surface;

(b) an elongated cord secured relative to said base member, said cord extending from a distal end of said cord which is locatable on the drive area, through the opening and across a portion of the lower surface to be secured remotely from the opening;

(c) a golf ball secured to the distal end of said cord whereby said golf ball is tethered to said base; and (d) a rod located proximately to the first location and operative to support said cord against abrasion caused by repeated striking of said golf ball secured thereto, said rod mounted on the lower surface of said base adjacent to the opening and oriented transversely to said cord with said cord being trained around said rod to protect said cord from abrasion against the opening.

* * * * *